United States Patent [19]

Fossati

[11] Patent Number: 4,662,541

[45] Date of Patent: May 5, 1987

[54] SPRAY ATOMIZER FOR PERFUMES OR THE LIKE LINKED PRODUCTS

[75] Inventor: Antonio Fossati, Milan, Italy

[73] Assignee: SA.FO.SA. S.r.l., Milan, Italy

[21] Appl. No.: 725,403

[22] Filed: Apr. 22, 1985

[30] Foreign Application Priority Data

May 8, 1984 [IT] Italy ..... 21713/84[U]

[51] Int. Cl.[4] ..... B67D 5/52

[52] U.S. Cl. ..... 222/135; 222/402.1; 239/305; D9/341

[58] Field of Search ..... 222/129, 135, 137, 173, 222/183, 402.1, 78–79, 182; 141/3, 20; 239/302, 305; D9/341, 415, 457

[56] References Cited

U.S. PATENT DOCUMENTS

| | | | |
|---|---|---|---|
| 3,269,605 | 8/1966 | Silver | 222/135 |
| 3,760,986 | 9/1973 | Castner et al. | 222/137 |
| 3,934,761 | 1/1976 | Gentreau | 222/183 |
| 4,433,796 | 2/1984 | Brooks, Jr. | 222/135 |
| 4,549,674 | 10/1985 | Alticosalian | 222/48 |

*Primary Examiner*—Joseph J. Rolla
*Assistant Examiner*—Michael S. Huppert

[57] ABSTRACT

The spray atomizer includes a casing containing two spray bottles, and a cover interfitting with the casing to secure the spray bottles within the casing. Each of the spray bottles has a spray valve and a push button associated with each spray valve, and the cover includes guides for the push buttons. The push buttons are adapted to slide within the casing along the guides of the cover. The spray bottles are positioned so that the spray valves face in opposite directions.

1 Claim, 2 Drawing Figures

SPRAY ATOMIZER FOR PERFUMES OR THE LIKE LINKED PRODUCTS

The present invention relates to a spray atomizer for perfumes or the like linked products, the combination and arrangment of the parts of which provide it with particularly useful characteristics.

The spray atomizer according to the invention is essentially characterized in that it comprises an envelope housing two small spray bottles containing two different perfumes or the like products and a pair of push-buttons associated with said envelope and each of which cooperates with the spray valve of one of said small bottles.

Figure 1:
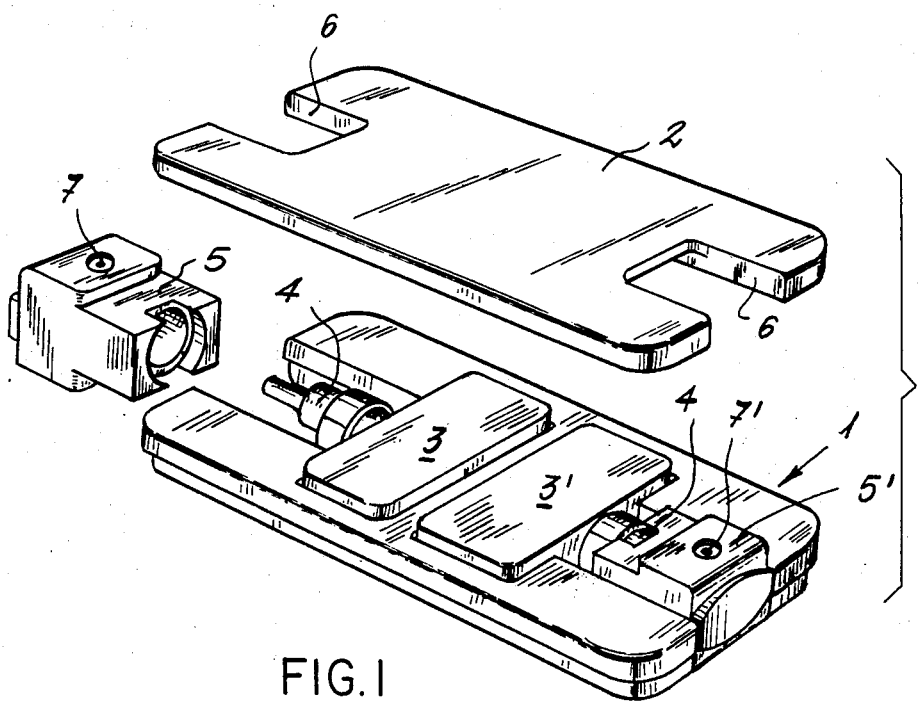
FIG. 1 is a partially exploded perspective view showing the casing prior to assembly.
Figure 2:
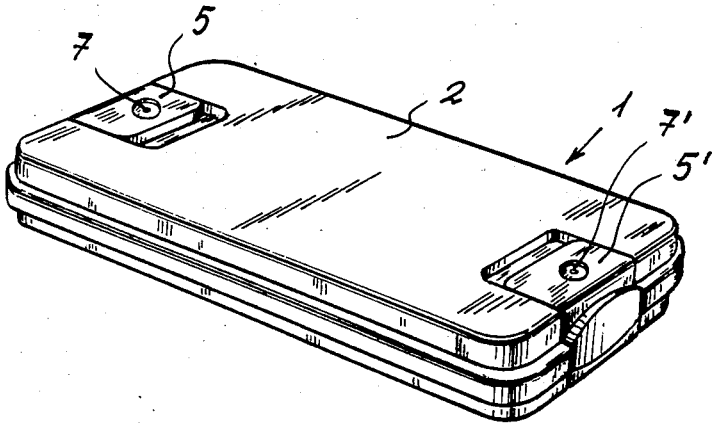
FIG. 2 is a perspective view of the casing in an assembled condition.

As is illustrated in the accompanying figures, within an envelope or casing 1, provided with a snap closing cover 2, there are housed two small spray bottles 3,3' each of which is provided with a small valve 4 cooperating with a push-button 5,5' capable of sliding along guides 6 as formed on the cover 2 and each provided with a dispensing nozzle 7,7'.

I claim:

1. A spray atomizer comprising a casing containing two spray bottles, a cover interfitting with said casing to secure said spray bottles within said casing, each of said spray bottles having a spray valve and a push button associated with each spray valve, said cover having guides adapted to be adjacent said push buttons, said push buttons being adapted to slide within said casing along said guides of said cover, said spray bottles being positioned so that said spray valves face in opposite directions.

* * * * *